US005551508A

United States Patent [19]

Lim et al.

[11] Patent Number: 5,551,508

[45] Date of Patent: Sep. 3, 1996

[54] CONDENSING UNIT USING CROSS-FLOW BLOWER

[75] Inventors: Alexander I. Lim, Brentwood; Richard DeVos, Murfreesboro; Jeffrey B. Scott, Antioch, all of Tenn.

[73] Assignee: Inter-City Products Corporation (USA), Lewisburg, Tenn.

[21] Appl. No.: 474,718

[22] Filed: Jun. 7, 1995

Related U.S. Application Data

[62] Division of Ser. No. 358,716, Dec. 19, 1994, which is a division of Ser. No. 958,951, Oct. 9, 1992, Pat. No. 5,404,939, which is a division of Ser. No. 712,942, Jun. 10, 1991, abandoned.

[51] Int. Cl.[6] ..... F28F 13/12

[52] U.S. Cl. ..... 165/122; 165/124; 165/DIG. 310; 165/DIG. 309; 62/259.1; 62/DIG. 16

[58] Field of Search ..... 165/122, 48.1, 165/124, 126; 62/259.1, DIG. 16

[56] References Cited

U.S. PATENT DOCUMENTS

| | | | |
|---|---|---|---|
| 2,004,571 | 6/1935 | Bothezat | 415/60 |
| 2,416,153 | 2/1947 | Cary | 62/115 |
| 2,905,091 | 9/1959 | Lippisch | 415/60 |
| 2,959,933 | 11/1960 | Burke | 62/183 |
| 3,035,760 | 5/1962 | Simmons | 165/122 |
| 3,073,132 | 1/1963 | Crider | 62/183 |
| 3,108,451 | 10/1963 | Clifford | 62/184 |
| 3,200,609 | 8/1965 | Laing | 165/121 |
| 3,251,540 | 5/1966 | Kinsworthy | 165/122 |
| 3,280,902 | 10/1966 | Laing | 165/122 |
| 3,302,426 | 2/1967 | Laing | 62/263 |
| 3,313,342 | 4/1967 | Laing | 165/124 |
| 3,324,939 | 6/1967 | Laing | 165/122 |
| 3,362,469 | 1/1968 | Berner et al. | 165/122 |
| 3,759,317 | 9/1973 | Vandiepenbroek | 165/124 |
| 3,759,320 | 9/1973 | Bullard | 165/122 |
| 4,043,708 | 8/1977 | Greenfield | 417/636 |
| 4,204,409 | 5/1980 | Satama | 62/271 |
| 4,240,264 | 12/1980 | Nakada | 165/122 |
| 4,416,327 | 11/1983 | Nakada | 165/122 |
| 4,733,543 | 3/1988 | Blair | 62/263 |
| 4,819,448 | 4/1987 | Campbell et al. | 62/259.1 |
| 4,832,116 | 5/1989 | Easton | 165/124 |
| 4,850,221 | 6/1989 | Dumas et al. | 165/124 |
| 4,958,504 | 9/1990 | Ichikawa | 165/122 |
| 5,060,717 | 10/1991 | Morita | 165/122 |
| 5,404,939 | 4/1995 | Lim et al. | 165/122 |

FOREIGN PATENT DOCUMENTS

| | | | |
|---|---|---|---|
| 1475284 | 3/1967 | France | 165/122 |
| 38760 | 3/1977 | Japan . | |
| 53-115545 | 9/1978 | Japan . | |
| 68544 | 5/1980 | Japan | 165/122 |
| 77632 | 6/1981 | Japan | 165/122 |
| 130815 | 8/1982 | Japan . | |
| 208523 | 12/1983 | Japan | 165/124 |
| 8635 | 1/1985 | Japan . | |
| 54538 | 3/1988 | Japan | 165/127 |
| 1-189435 | 7/1989 | Japan . | |

*Primary Examiner*—Leonard R. Leo
*Attorney, Agent, or Firm*—Baker & Daniels

[57] ABSTRACT

The present invention involves split system air conditioners. Specifically, the present invention provides a condenser unit with cross-flow blowers. A single cross-flow blower may be used to draw air through a heat exchanger and expel the air adjacent to a cut-off portion. Further, dual cross-flow blowers may be provided to enhance the performance of the condenser unit. The combination of air streams from two cross-flow blowers provide better air circulation through the heat exchangers and a more uniform exhaust stream. The condenser unit is more compact and can be mounted on the wall, on the overhang, or on the top of the building. These various mounting locations take advantage of the air boundary layer near the building and thus the air conditioning system operates more efficiently.

4 Claims, 4 Drawing Sheets

CONDENSING UNIT USING CROSS-FLOW BLOWER

This is a division of application Ser. No. 08/358,716, filed Dec. 19, 1994, which is a division of application Ser. No. 07/958,951, filed Oct. 9, 1992, which is a division of application Ser. No. 07/712,942, filed Jun. 10, 1991, abandoned.

BACKGROUND OF THE INVENTION

1. Field of the Invention

The present invention relates to split system air conditioners and heat pumps. More specifically, the field of the invention is that of outdoor units for split system air conditioners and heat pumps.

2. Prior Art

Split system air conditioners and heat pumps are well known for heating and cooling residential and commercial buildings. The following examples describe conventional outdoor condensing units for air conditioners. Inside the building, an evaporator unit cools air circulated through the evaporator's refrigerant coils which contain circulating refrigerant fluid. Outside the building, the condenser unit dissipates heat into outdoor air passing through the condenser's refrigerant coils which also contain circulating refrigerant fluid. Lines for communication of refrigerant fluid connect the evaporator and condenser units to form a fluid circuit. Further, the air conditioner's compressor is conventionally disposed with the condenser unit outside the building, although the compressor may be disposed at any point provided it is in communication with the refrigerant fluid circuit. The above described arrangement may be switched by reversing a valve in the refrigerant fluid circuit so that the split system air conditioner acts as a heat pump to warm the indoor air and absorb heat from the outdoor air.

Condenser units for split system air conditioners are relatively larger than the condenser portions of room air conditioners, and are conventionally disposed on a concrete slab adjacent to the building with fluid lines connecting it to the compressor and the evaporator. In one conventional condenser unit configuration, one or more sides of the condensing unit include heat exchanger coils, and a large axial fan is positioned at the top of the condenser unit so that air is drawn through the heat exchanger coils and expelled out the top of the condenser unit. In another conventional condenser unit, an axial fan draws outdoor air through a side of the condenser, forces the outdoor air through a heat exchanger, and expels the outdoor air out the other side.

However, several disadvantages of conventional condenser units exist, particularly in terms of sound and efficiency. The condenser fans often produce an undesirable amount of noise. Often, condensing units are spaced away from the building to isolate this noise, away from the exterior wall boundary layer of outdoor air having ambient temperatures which are closer to the desired indoor temperature. This placement of condensing units outside and away from buildings also interferes with the landscaping around the building. Further, for apartments and condominiums, the condensing units take up scarce outdoor patio space.

The boundary air has lower ambient temperature because the sides of the building influence the outdoor boundary air by giving off or absorbing heat from the outdoor air. Under normal operating conditions, the building interior is closer to the desired indoor temperature than the outdoor air, and the temperature gradient from directly adjacent the building to several feet from the building may vary by up to 5°. The condenser unit may be spaced away from the building and its boundary air, thus decreasing the efficiency of the air conditioner because it cannot take advantage of the temperature gradient from the boundary layer.

Another disadvantage of prior art condenser units involves the performance characteristics of axial fans. One important characteristic of a fan is its efficiency operating with heat exchangers having different pressure drops. Axial fans operate efficiently with heat exchangers having lower pressure drops. On the other hand, tangential or cross-flow fans can operate as efficiently with heat exchangers having higher pressure drops.

An advantage of cross-flow fans is that the fan extends across substantially the entire length of the heat exchanger coils, resulting in a more uniform airflow across the coils. This allows the cross-flow fan to operate at a higher speed, causing a greater air velocity and a higher heat transfer coefficient, and thereby requiring less heat exchanger surface area. Reducing the required heat exchanger surface area is desirable because that lowers the overall cost of the air conditioner.

However, conventional designs combined with cross-flow fans do not possess the same operating efficiencies because of a significant portion of the air passing through the cross-flow blower is recirculated within the condenser. Recirculating air impairs the efficiency of the condenser by lowering the temperature difference between the circulating refrigerant fluid and the air passing over the heat exchanger. Therefore, conventionally designed condenser units are not designed to effectively operate with cross-flow fans.

What is needed is a more efficient condenser unit for a split system air conditioner or heat pump.

Also needed is such a condenser unit which produces less noise.

Another need is for a condenser unit which occupies minimal outdoor space.

An additional need is for a condenser unit which may effectively operate with smaller heat exchangers.

A further need is for a condenser unit which effectively operates with cross-flow fans.

SUMMARY OF THE INVENTION

The present invention is a condenser unit for an air conditioning system, or an outdoor unit for a heat pump, which includes a cross-flow blower. The cross-flow blower is disposed so that air is drawn through the heat exchanger and expelled from the condenser at a point isolated from the air intake. The unit is thinner than a conventional condenser and may be mounted on the wall of a building. With this arrangement, the boundary air near the building is induced through the heat exchanger thereby improving the thermodynamic efficiency of the air conditioning system. Also, the cross-flow blower generates less noise than an axial fan used with a similarly sized condenser.

The placement of the unit minimizes the amount of surface area space occupied near the building. For residential homes, mounting the condenser on the wall keeps the condenser from interfering with the landscaping of the home. For apartment and condominium complexes, the wall mounted condenser does not occupy any of the limited surface space.

The outdoor unit of the present invention utilizes cross-flow fans which are inherently more efficient than axial fans.

A further advantage of using cross-flow fans in the condenser unit involves the ability to utilize smaller heat exchanger coils and/or smaller horsepower fan motors without sacrificing the capacity of the air conditioner. Cross-flow or tangential blowers operate most efficiently at higher pressure ratios than axial blowers which results in reduced heat exchanger surface area requirements. The reduction in heat exchanger surface area allows for smaller heat exchangers and a correspondingly lower cost.

The present invention is, in one form, a split system air conditioner for conditioning air inside a building. The split air conditioner comprises a fluid circuit, an indoor module, and an outdoor module. The fluid circuit circulates refrigerant fluid through an indoor heat exchanger and an outdoor heat exchanger. The indoor module is disposed within the house, and includes the indoor heat exchanger and an air moving device for circulating indoor air about the indoor heat exchanger. The outdoor module is disposed in communication with the exterior of the house, and includes the outdoor heat exchanger and a cross-flow blower arranged to cause outdoor air to circulate about the outdoor heat exchanger.

The present invention, in another form, is a split system air conditioner for conditioning air inside a building. The split air conditioner comprises a fluid circuit, an indoor module, and outdoor module, and a device for rotating cross-flow blowers of the outdoor module. The fluid circuit circulates refrigerant fluid through an indoor heat exchanger and two outdoor heat exchangers. The indoor module is disposed within the house, and includes the indoor heat exchanger and an air moving device for circulating indoor air about the indoor heat exchanger. The outdoor module is disposed in communication with the exterior of the house, and includes the outdoor heat exchangers, and two cross-flow blowers, with the cross-flow blowers arranged to induce outdoor air flow through their respective outdoor heat exchanger. The device for rotating the cross-flow blowers includes a single motor which causes one cross-flow blower to rotate in a first direction and the other cross-flow blower to rotate in an opposite second direction.

One object of the present invention is to provide a more efficient condenser for a split system air conditioner or heat pump.

Also an object is to provide such a condenser unit which produces less noise.

Another object is to provide a condenser unit which occupies minimal outdoor space.

An additional object is to provide a condenser unit which may effectively operate with smaller heat exchangers.

A further object is to provide a condenser unit which effectively operates with cross-flow fans.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
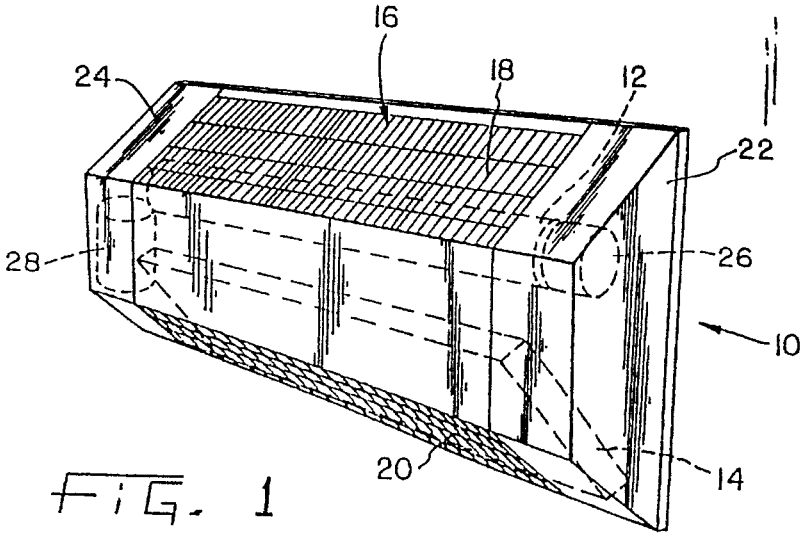
FIG. 1 is a perspective view of a first embodiment of a condenser unit of the present invention.

Corresponding reference characters indicate corresponding parts throughout the several views. The exemplification set out herein illustrates preferred embodiments of the invention, in several forms, and such exemplifications are not to be construed as limiting the scope of the invention in any manner.

DESCRIPTION OF THE PREFERRED EMBODIMENTS

The present invention relates to split system air conditioning systems, particularly to condenser 10 of such a system shown in FIG. 1. However, condenser 10 may also be the outdoor portion of a heat pump system. Condenser 10 includes tangential, cross-flow blower 12 and heat exchanger coils 14 located in air handling portion 16. Cross-flow blower 12 is positioned near upper outlet grid 18 and is disposed to draw outdoor air through lower inlet grid 20 and heat exchanger coils 14 then emit the air through outlet grid 18. Heat exchanger coils 14 are positioned near inlet 20 and substantially prevent air from entering air handling portion 16 without the air first passing through heat exchanger coils 14.

Although not essential, condenser 10 may also include side portions 22 and 24 which may contain other elements of the split system air conditioning unit. In the exemplary embodiment, side portion 22 includes motor 26 which rotatably drives blower 12 and side portion 24 includes compressor unit 28 which supplies refrigerant fluid to heat exchanger coils 14. Side portions 22 and 24 are preferably separated from air handling portion 16 by walls (not shown) so that residual heat from the interior of side portions 22 and 24 does not effect coils 14.

Also, the wall supporting motor 26 may also include a hole adjacent to motor 26 for cooling motor 26, as described by copending application Ser. No. 07/561,890, entitled "METHOD AND APPARATUS FOR COOLING MOTORS OF CROSS FLOW BLOWERS", filed on Aug. 2, 1990, assigned to the assignee of the present invention, the disclosure of which is explicitly incorporated by reference.

Figure 2:
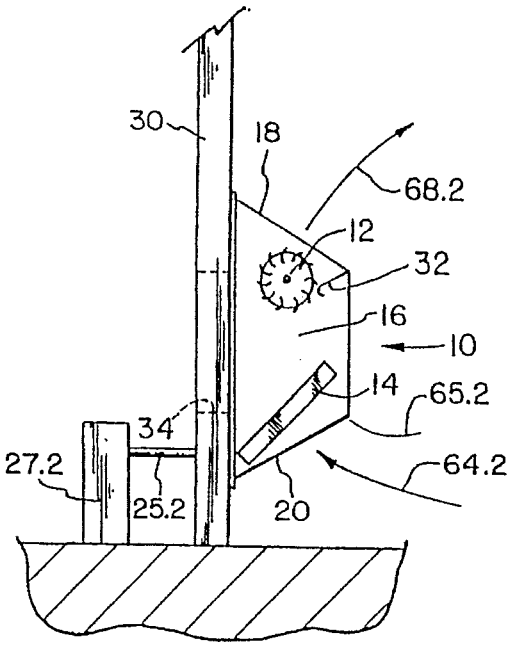
FIG. 2 is a side view, in partial cross-section, of the condenser unit of FIG. 1.

As shown in FIG. 2, condenser 10 may be vertically mounted on wall 30 so that inlet 20 faces downward and outlet 18 faces upward. Cut-off 32 is positioned in air handling portion 16 to facilitate the movement of air from inlet 20 upwardly through heat exchanger 14 to blower 12 which expels air along outlet path 68.2 through outlet 18. With this arrangement, air which runs through boundary layer 65.2 is closer in temperature to the desired indoor temperature and is drawn through inlet 20. For example, in the winter, air in boundary layer 65.2, located near the building at ground level, is generally warmer than the rest of the outdoor air, so that warmer air is induced along inlet path 64.2 through heat exchanger 14. Similarly, in the summer, boundary layer 65.2 is generally cooler than the rest of the outdoor air, so that cooler air is induced along inlet path 64.2 through heat exchanger 14. The efficiency of the air conditioning unit is improved when the outdoor air passing through heat exchanger 14 is closer to the desired indoor temperature.

Condenser 10 may be conventionally mounted on wall 30, and fluid conduits 25.2 connect heat exchanger 14 with indoor portion 27.2 (which may include another heat exchanger, an indoor blower, electric strip heat, etc.) of the split system air conditioning unit. Wall 30 may include aperture 34 which allows easy access to air handling portion 16 or side portions 22 and 24 for repair or replacement of any of the components disposed inside. With this arrangement, condenser 10 may be mounted on the wall of a house and not occupy any additional area around the house. Another advantage of this mounting location is that the compressor controls are located in the outdoor unit and still may be easily accessed in the winter, where conventional three piece heat pumps require a separate cabinet to be located inside the house, typically in the basement. Further, motor 26 may run blower 12 at high speeds and produce less noise than a conventional motor running slower for an axial fan, so that no additional noise is noticeable on the indoor side of wall 30.

Figure 4:
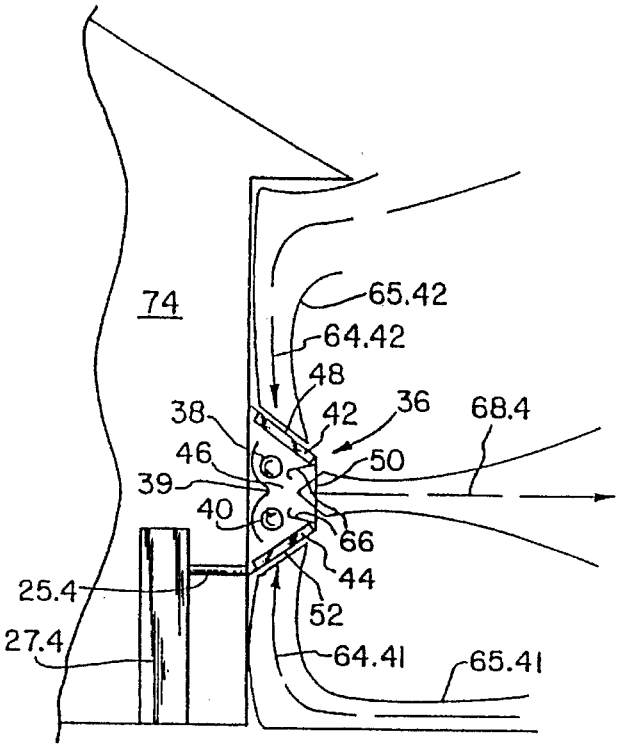
FIG. 4 is a side view, in partial cross-section, of the condenser unit of FIG. 3.
Figure 3:
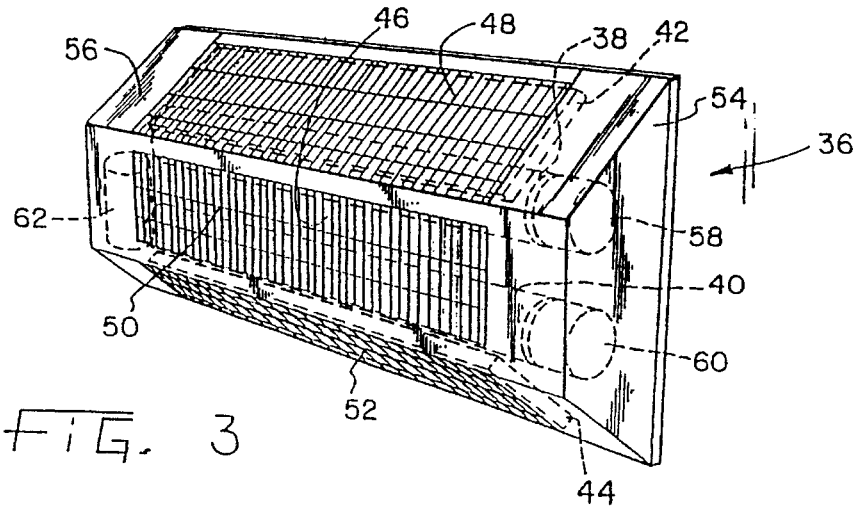
FIG. 3 is a perspective view of a second embodiment of a condenser unit of the present invention.

In accordance with the present invention, condenser 36 includes dual cross-flow blowers as shown in FIGS. 3 and 4. Condenser 36 includes tangential, cross-flow blowers 38 and 40 adjacent to scroll portion 39 and arranged with respective heat exchanger coils 42 and 44 located in air handling portion 46. Upper cross-flow blower 38 is positioned near upper inlet grid 48 and is disposed to draw outdoor air through upper inlet grid 48 and heat exchanger coils 42 then emit the air through outlet grid 50. Scroll portion 39 has a spiral shape on its upper half adjacent to blower 38, to guide air flow through the upper portion of air handling portion 46. Heat exchanger coils 42 are positioned near upper inlet 48 and substantially prevent air from entering the upper portion of air handling portion 46 without the air first passing through heat exchanger coils 42. Lower cross-flow blower 40 is positioned near lower inlet grid 52 and is disposed to draw outdoor air through lower inlet grid 52 and heat exchanger coils 44 then emit the air through outlet grid 50. Scroll portion 39 also has a spiral shape on its lower half adjacent to blower 40, to guide air flow through the lower portion of air handling portion 46. Heat exchanger coils 44 are positioned near lower inlet 52 and substantially prevent air from entering the lower portion of air handling portion 46 without the air first passing through heat exchanger coils 44.

Although not essential, condenser 36 may also include side portions 54 and 56 which may contain other elements of the split system air conditioning unit. In the exemplary embodiment, side portion 54 includes motors 58 and 60 which rotatably drive blower 38 and 40, respectively. In addition, side portion 56 includes compressor unit 62 which supplies refrigerant fluid to eat exchanger coils 42 and 44. Side portions 54 and 56 are preferably separated from air handling portion 46 by walls (not shown) so that residual heat from the interior of side portions 54 and 56 does not effect coils 42 and 44.

In accordance with the present invention, motors 58 and 60 are arranged to rotate blowers 38 and 40 in opposite directions. Thus, upper cross-flow blower 38 rotates counter-clockwise and lower cross-flow blower 40 rotates clockwise to induce air flow into air handling portion 46 along inlet paths 64.41 and 64.42 which run through boundary layers 65.41 and 65.42. Cut-offs 66 are positioned in air handling portion 46 in relation to blowers 38 and 40 to direct the expelled air perpendicularly through outlet 50.

Cross-flow blowers generally cause air flow having a radial velocity which may be problematic for air conditioning units because the radial velocity of the air flow may cause feedback through the heat exchanger, thus detracting from the efficiency of the heat exchanger. However, with the arrangement of condenser 36, the air flows from blowers 38 and 40 combine and this combination of air flows cancels out the radial component of the air flow velocity. As a result, a remarkably straight flow of air occurs along outlet path 68.4 which does not tend to feed back into inlets 48 or 52. The counter-clockwise radial component of the velocity from blower 38 combines with the clockwise radial component of the air flow from blower 40 and produces a generally straight air flow. After removing the radial velocity components, the resulting air flow is not only straight, but has a significant increase in tangential velocity. This cancellation of radial velocity components of air flows from cross-flow blowers to produce a generally linear air flow is know as the Coanda effect.

Figure 5:
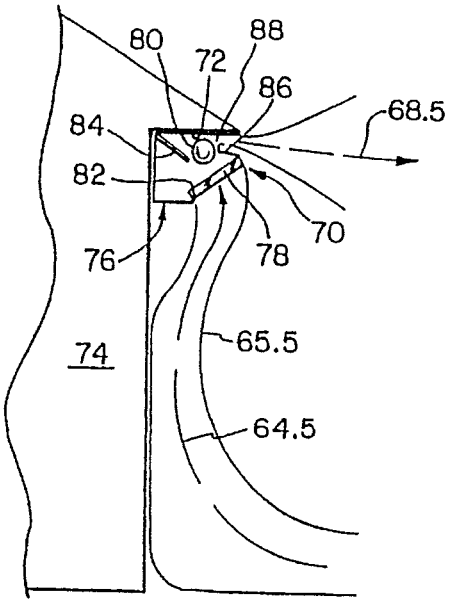
FIG. 5 is a side view, in partial cross-section, of a third embodiment of a condenser unit.

Other embodiments of the present invention are depicted in FIGS. 5–8. In FIG. 5, condenser unit 70 is mounted on overhang or Jetty 72 of house 74. Condenser 70 includes housing 76, heat exchanger coils 78, and cross-flow blower 80. Heat exchanger coils 78 are disposed in inlet portion 82 of housing 76 so that cross-flow blower 80 induces air to move along inlet path 64.5 from boundary layer 65.5, through heat exchanger 78, to blower 80. Blower 80 is positioned adjacent to partition 84 and cut-off 86 of housing 76 so that as blower 80 rotates in a clockwise direction. The air coming out of heat exchanger 78 is drawn between partition 84 and cut-off 86 into blower 80 and expelled through outlet 88 which is defined between cut-off 86 and overhang 72.

In addition to air in boundary layer 65, which is adjacent to the building, generally having a temperature closer to the desired indoor ambient, air which is spaced above the ground and away from other objects tends to have a temperature which is also closer to the ambient. In the summer, for example, air located close to the ground tends to receive heat reflected from the surface, particularly surfaces consisting of rock, gravel, or concrete. In the winter, the colder air settles to the surface so that slightly warmer air remains spaced well above the surface. In either case, air in upper layer 67 tends to be closer to the desired indoor ambient, and thereby increases efficiency much like boundary layer 65. The condenser units shown in FIGS. 6–8 utilize air in upper layer 67 to improve their efficiency.

Figure 6:
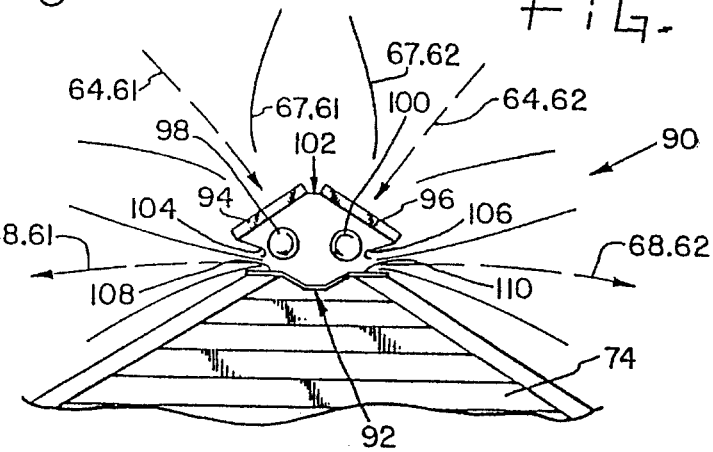
FIG. 6 is a side view, in partial cross-section, of a fourth embodiment of a condenser unit.

In FIG. 6, condenser unit 90 is positioned on the peak or ridge 92 of house 74 and has heat exchanger coils 94 and 96 facing air in upper layers 67.61 and 67.62. Cross-flow blowers 98 and 100 are located in condenser housing 102 and are positioned adjacent to cut-offs 104 and 106 of housing 102. Blowers 98 and 100 are disposed to rotate in opposite directions so that blower 98 induces air to flow from upper layer 67.61, through heat exchanger 94, then expels the air through outlet 108; and blower 100 induces air to flow from upper layer 67.62, through heat exchanger 96, then expels the air through outlet 110. Other variations on the configuration of FIG. 6 include having the blowers draw attic air through the heat exchanger coils for a heat pump during winter, or having the blowers induce air movement in the attic during the summer to reduce the air conditioning load on the rest of the house.

Figure 7:
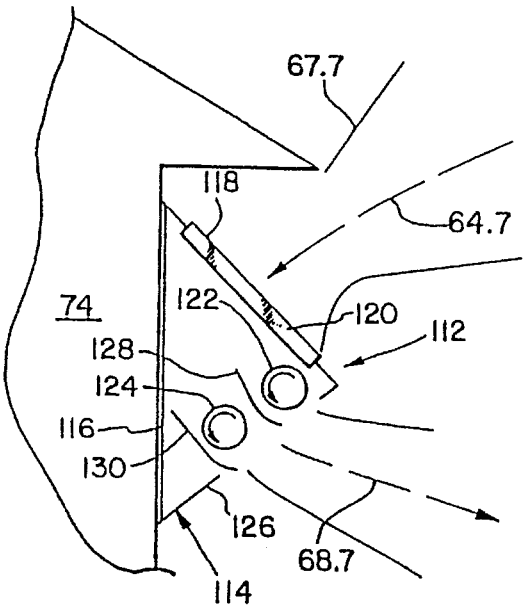
FIG. 7 is a side view, in partial cross-section, of a fifth embodiment of a condenser unit.

A wall mounted unit having two tangential blowers rotating in the same direction is shown in FIG. 7. Condenser unit 112 includes generally triangular housing 114 having a mounting side 116 attached to house 74. Housing 114 also has an upwardly facing inlet side 118 with heat exchanger coils 120 disposed across inlet side 118. Cross-flow blowers 122 and 124 are located adjacent to outlet side 126 of housing 114 and are disposed proximate to scroll portions 128 and 130 of housing 114, respectively. Blowers 122 and 124 rotate in the same direction so that air is induced to flow from upper layer 67.7 through heat exchanger 120, then to blower 122 or 124 where the air is guided along scroll portions 128 and 130, respectively, and expelled through outlet side 126. With the arrangement of condenser 112, the air flows from blowers 122 and 124 combine and cancel out a significant portion of the radial component of the air flow velocity to produce a generally straight air flow. As a result, a generally straight flow of air occurs along outlet path 68.7 and does not tend to feed back into inlet side 118. After combining the radial velocity components, the resulting air flow is not only generally straight, but has a significant increase in tangential velocity.

Figure 8:
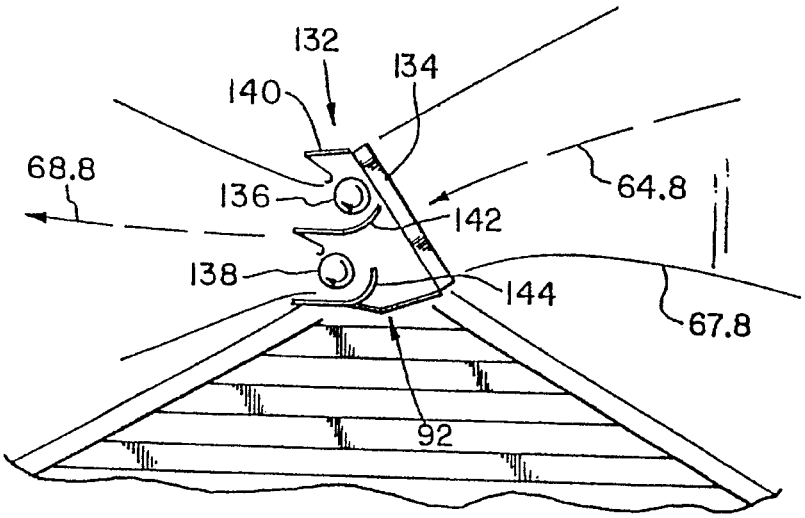
FIG. 8 is a side view, in partial cross-section, of a sixth embodiment of a condenser unit.

Another configuration for mounting on a rooftop is shown in FIG. 8. Condenser unit 132 is mounted on peak 92 and includes heat exchanger 134, cross-flow blowers 136 and 138, and scroll portions 140, 142, and 144. Blowers 136 and 138 are disposed to rotate in the same direction, with blower 136 positioned between scroll portions 140 and 142 and blower 138 positioned between scroll portions 142 and 144. When rotating, blowers 136 and 138 induce air from upper layer 67.8 through heat exchanger 134 and expel the air between scroll portions 140, 142, and 144 to produce a generally straight air flow. As a result, a generally straight flow of air occurs along outlet path 68.8 which does not tend to feed back into heat exchanger 134. After combining the radial velocity components, the resulting air flow is not only generally straight, but has a significant increase in tangential velocity.

Figure 9:
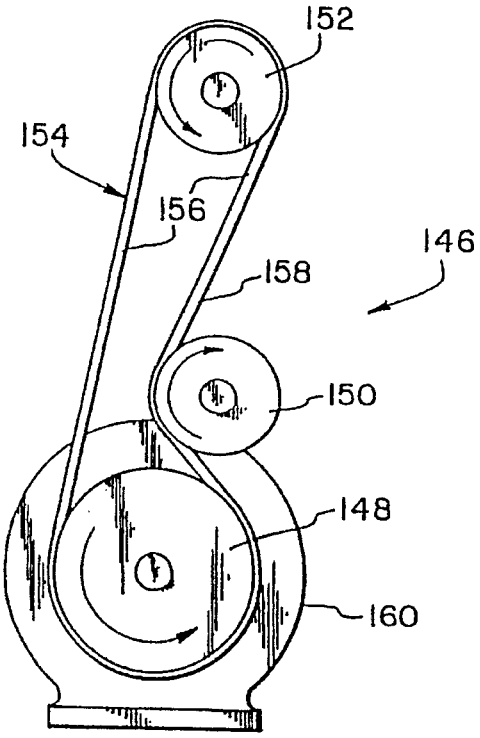
FIG. 9 is a schematic representation of idler belt drive.

Another aspect of the present invention, namely belt idler drive 146, is shown in FIG. 9. Belt idler 146 provides a mechanism which rotates two fans in opposite directions using a single motor 160. Replacing motors 58 and 60 of condenser unit 36 (FIGS. 2 and 3), a suitably configured motor 160 (similar to motors 58 and 60, but with more power) may be attached to idler pulley 148 to drive blower pulleys 150 and 152 by means of belt 154. Belt 154 has interior engaging surface 156 which engages the periphery of idler pulley 148 and blower pulley 152 so that pulleys 148 and 152 rotate in the same direction. Also, belt 154 has exterior engaging surface 158 which engages the periphery of blower pulley 150 so it turns in an opposite direction to pulleys 148 and 152. To facilitate the engagement of the peripheries of the pulleys with belt 154, idler pulley 148 has a larger diameter and its axis is slightly offset from a plane defined by the axes of blower pulleys 150 and 152. With this arrangement, a sufficient amount of the peripheries of the pulleys are engaged to maintain the rotatable coupling of belt 154. Belt idler 146 may be disposed in side portion 54 or 56 to drive cross-flow blowers 38 and 40 of condenser 36, for example.

Figure 11:
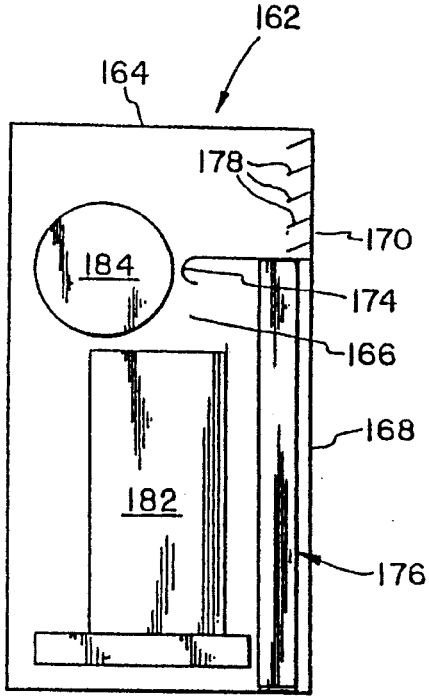
FIG. 11 is a section view, taken along view lines 11—11 of FIG. 10.
Figure 10:
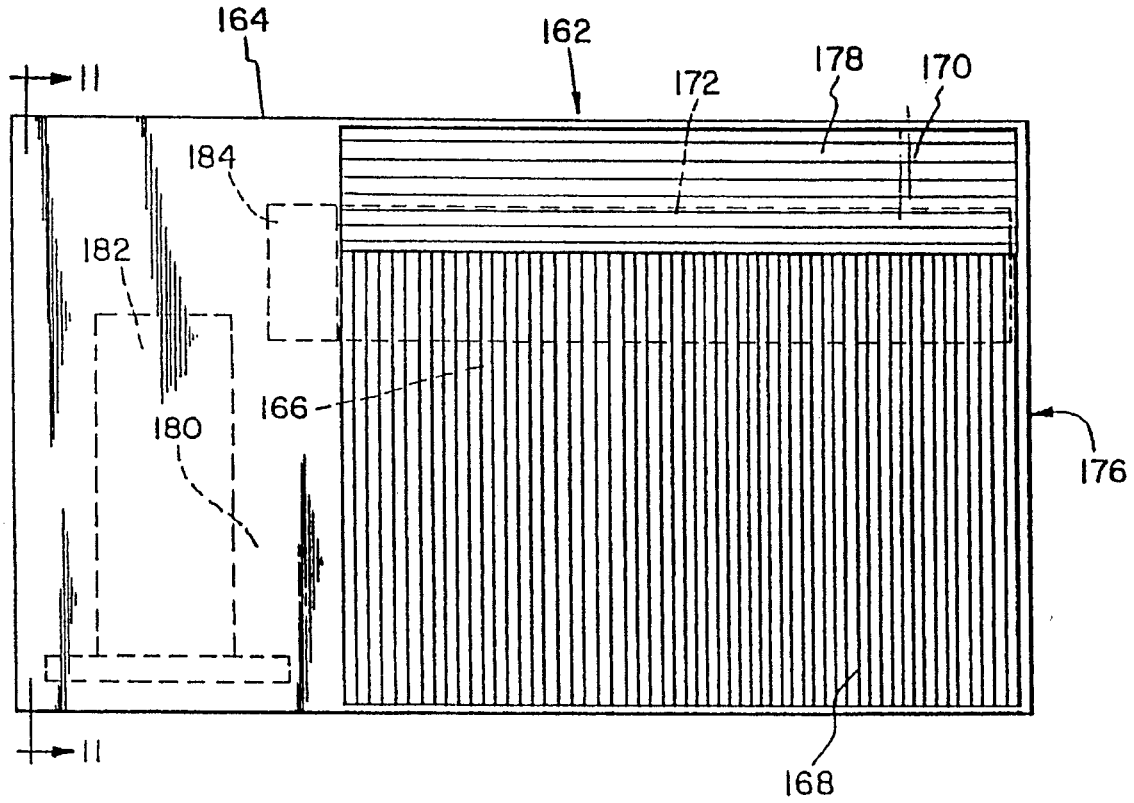
FIG. 10 is a front view of an alternative embodiment of the present invention.

An alternative embodiment of the wall mounted single cross-flow blower unit is shown as condenser unit 162 in FIGS. 10 and 11. Generally rectangular housing 164 defines air handling portion 166 which has an air inlet 168 and an air outlet 170. Cross-flow blower 172 is disposed in the interior of air handling portion 166 and adjacent to cut-off portion 174 to induce air through inlet 168 and expel the air through outlet 170. Heat exchanger coils 176 are disposed in air inlet 168 and louvers 178 are disposed above cut-off portion 174 in air outlet 170. Louvers 178 are structured and arranged so that air flowing out of outlet 170 is guided away from inlet 168 and does not tend to recirculate through heat exchanger coils 176.

In addition to air handling portion 166, housing 164 also includes compartment 180 which contains compressor 182 and motor 184. Housing 164 is adapted to be mounted on the wall of a building similar to the connection of condenser unit 10 of FIG. 2. One advantage of the arrangement of condenser 162 involves lessening the materials needed to manufacture housing 164 because vertically disposed heat exchanger coils 176 form one of the sides of the unit.

As an exemplary embodiment, condenser unit 36 (of FIGS. 3 and 4) includes two ¼ horsepower motors or alternatively one ½ horsepower motor with the belt idler drive, a housing preferably constructed from sheet metal or molded plastic, two rectangular heat exchanger coils having a length of about 48 inches, a width of about 14 inches, and a depth of about 1.7 inches, and two five (5) inch tangential blowers. Condenser 36 is designed to be paired with a three (3) ton indoor unit.

While this invention has been described as having a preferred design, the present invention can be further modified within the spirit and scope of this disclosure. For example, although the invention is sometimes described as a condenser for an air conditioning unit, the present invention also includes a similar unit used as the outdoor portion of a heat pump. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A split system air conditioner for conditioning air inside a building, said split air conditioner comprising:

fluid circuit means for circulating refrigerant fluid through an indoor heat exchanger and an outdoor heat exchanger;

an indoor module disposed within the building, said indoor module including said indoor heat exchanger and means for circulating indoor air about said indoor heat exchanger; and an outdoor module disposed in communication with the exterior of the building, said outdoor module including said outdoor heat exchanger, and first and second cross-flow blowers, with said first and second cross-flow blowers arranged to cause outdoor air to circulate about said outdoor heat exchanger, said outdoor module including a housing having an angled top wall and means for attaching said outdoor module to a peak of a similarly angled roof top of the building.

2. The split system air conditioner of claim 1 wherein said outdoor module further includes means for rotating said cross-flow blowers, said rotating means including a single motor which causes said first cross-flow blower to rotate in a first direction and said second cross-flow blower to rotate in an opposite second direction.

3. The split system air conditioner of claim 2 wherein said rotating means includes pulley means for operably connecting said first and second cross-flow blowers to said motor, said pulley means including an idler shaft so that said first cross-flow blower is rotated in the same direction as said motor and said second cross-flow blower is rotated in the opposite direction as said motor.

4. A split system air conditioner for conditioning air inside a building said split air conditioner comprising:

fluid circuit means for circulating refrigerant fluid through an indoor heat exchanger and an outdoor heat exchanger;

an indoor module disposed within the building, said indoor module including said indoor heat exchanger and means for circulating indoor air about said indoor heat exchanger; and an outdoor module disposed in communication with the exterior of the building, said outdoor module including said outdoor heat exchanger, and first and second cross flow blowers, with said first and second cross flow blowers arranged to cause outdoor air to circulate about said outdoor heat exchanger, said outdoor module including a housing having means for attaching said outdoor module to a rooftop of the building, said outdoor module further including a second heat exchanger and means for rotating said cross-flow blowers, said rotating means including a single motor which causes a first of said cross-flow blowers to rotate in a first direction and a second of said cross-flow blowers to rotate in an opposite second direction whereby said first heat exchanger is disposed facing one side of the building and said second heat exchanger is disposed facing the other side of the building, with said first cross-flow blower inducing air through said first heat exchanger and expelling the air on the one side of the building, and said second cross-flow blower inducing air through said second heat exchanger and expelling the air on the other side of the building.

* * * * *

UNITED STATES PATENT AND TRADEMARK OFFICE

CERTIFICATE OF CORRECTION

PATENT NO. : 5,551,508

DATED : September 3, 1996

INVENTOR(S) : Alexander T. Lim et al

It is certified that error appears in the above-indentified patent and that said Letters Patent is hereby corrected as shown below:

On the title page, item [75], delete "Alexander I. Lim" and substitute therefor --Alexander T. Lim--.

Signed and Sealed this

Twenty-sixth Day of November 1996

*Attest:*

*Attesting Officer*

Bruce Lehman

BRUCE LEHMAN

*Commissioner of Patents and Trademarks*